US008139997B2

(12) United States Patent
Shimizu

(10) Patent No.: US 8,139,997 B2
(45) Date of Patent: Mar. 20, 2012

(54) IMAGE FORMATION DEVICE

(75) Inventor: Noriyuki Shimizu, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 1058 days.

(21) Appl. No.: 11/839,653

(22) Filed: Aug. 16, 2007

(65) Prior Publication Data

US 2008/0253819 A1 Oct. 16, 2008

(30) Foreign Application Priority Data

Aug. 25, 2006 (JP) ..... 2006-229731

(51) Int. Cl.
*G03G 15/00* (2006.01)

(52) U.S. Cl. ..... 399/405; 399/316

(58) Field of Classification Search ..... 399/405, 399/316

See application file for complete search history.

(56) References Cited

U.S. PATENT DOCUMENTS 4,444,388 A * 4/1984 Stefannson et al. ..... 271/293
4,972,236 A * 11/1990 Hasegawa ..... 399/16
5,800,076 A * 9/1998 Umeda ..... 400/645.3
5,974,283 A * 10/1999 Cho ..... 399/75
7,379,709 B2 * 5/2008 Sun et al. ..... 455/41.2
2007/0242998 A1 * 10/2007 Ishio et al. ..... 399/405

FOREIGN PATENT DOCUMENTS

JP 2763166 3/1998
JP 2005-314041 A 11/2005

* cited by examiner

*Primary Examiner* — Ren Yan
*Assistant Examiner* — Allister Primo
(74) *Attorney, Agent, or Firm* — Global IP Counselors

(57) ABSTRACT

An image formation device includes an image formation unit, a paper feed unit, a paper discharge unit and a guide unit. The image formation unit prints an image on a recording paper conveyed along an image formation path. The paper feed unit feeds the recording paper to the image formation unit along a paper feed path. The paper discharge unit discharges the recording paper along a paper discharge path. The guide unit is disposed adjacent to a branching point where the paper feed path and the paper discharge path diverge. The guide unit includes a first guide portion and second guide portion. The first guide portion is disposed above the paper feed path and below the paper discharge path and guides the recording paper along the paper feed path and the paper discharge path. The second guide portion is disposed above the paper discharge path and guides the recording paper along the paper discharge path. The first guide portion and the second guide portion are formed integrally.

11 Claims, 4 Drawing Sheets

IMAGE FORMATION DEVICE

CROSS-REFERENCE TO RELATED APPLICATIONS

This application claims priority to Japanese Patent Application No. 2006-229731 filed on Aug. 25, 2006. The entire disclosure of Japanese Patent Application No. 2006-229731 is hereby incorporated herein by reference.

BACKGROUND OF THE INVENTION

1. Field of the Invention

The present invention generally relates to an image formation device. More specifically, the present invention relates to an image formation device having a member for guiding recording paper.

2. Background Information

A conventional image formation device includes an image formation unit having a thermal head. With the conventional image formation device, an ink ribbon coated with a sublimation dye is laid over recording paper (printer paper). Electrical energy corresponding to image information is applied to the thermal head. Thermal energy generated by the thermal head sublimates the sublimation dye coating of the ink ribbon and transfers the sublimation dye onto the recording paper to perform specific printing, such as color printing. With the conventional image formation device, rendering of images having gradation is performed by controlling amounts of current sent to the thermal head, that is, amounts of heat generated by the thermal head.

When color printing is performed with the conventional image formation device, the recording paper is sent a number of times (for example, three or four times) to the image formation unit. The recording paper is stacked in a paper feed cassette. The recording paper is first conveyed to a point downstream from the image formation unit. Then, the recording paper is conveyed in a direction of a discharge component provided at a top of the paper feed cassette while ink (such as yellow ink (Y)) is transferred from the ink ribbon to the recording paper. Then, the recording paper is conveyed to the point downstream from the image formation unit, and magenta (M) ink is transferred over the recording paper in a same manner as with the yellow ink above. Then, cyan (C) ink is transferred similarly. Furthermore, overcoating is performed as needed.

The conventional image formation device further includes a switching guide, a paper feed guide and a paper discharge guide to convey the recording paper as above (see, for example, Japanese Patent No. 2,763,166). The switching guide is provided near a branching point of a conveyance path where a paper feed path and a paper discharge path diverged. The paper feed guide is provided on a top side of the paper feed path where the recording paper passed through. The paper discharge guide is provided on a top side of the paper discharge path where the recording paper passed through.

With the conventional image formation device, the paper feed guide and the paper discharge guide are necessary in addition to the switching guide. Therefore, the number of parts and the number of assembly steps are increased. As a result, the cost of the conventional image formation device is increased.

In view of the above, it will be apparent to those skilled in the art from this disclosure that there exists a need for an improved image formation device. This invention addresses this need in the art as well as other needs, which will become apparent to those skilled in the art from this disclosure.

SUMMARY OF THE INVENTION

The present invention was conceived in light of the above problems. It is one object of the present invention to provide an image formation device which requires fewer parts.

In accordance with one aspect of the present invention, an image formation device includes an image formation unit, a paper feed unit, a paper discharge unit and a guide unit. The image formation unit is configured to print an image on a recording paper conveyed along an image formation path. The paper feed unit is configured to feed the recording paper to the image formation unit along a paper feed path. The paper discharge unit is configured to discharge the recording paper along a paper discharge path. The guide unit is disposed adjacent to a branching point where the paper feed path and the paper discharge path diverge. The guide unit includes a first guide portion and a second guide portion. The first guide portion is disposed above the paper feed path and below the paper discharge path. The first guide portion is configured to guide the recording paper along the paper feed path and the paper discharge path. The second guide portion is disposed above the paper discharge path. The second guide portion is configured to guide the recording paper along the paper discharge path. The first guide portion and the second guide portion are formed integrally.

With the image formation device, it is possible to provide an image formation device which requires fewer parts.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENT

Figure 1:
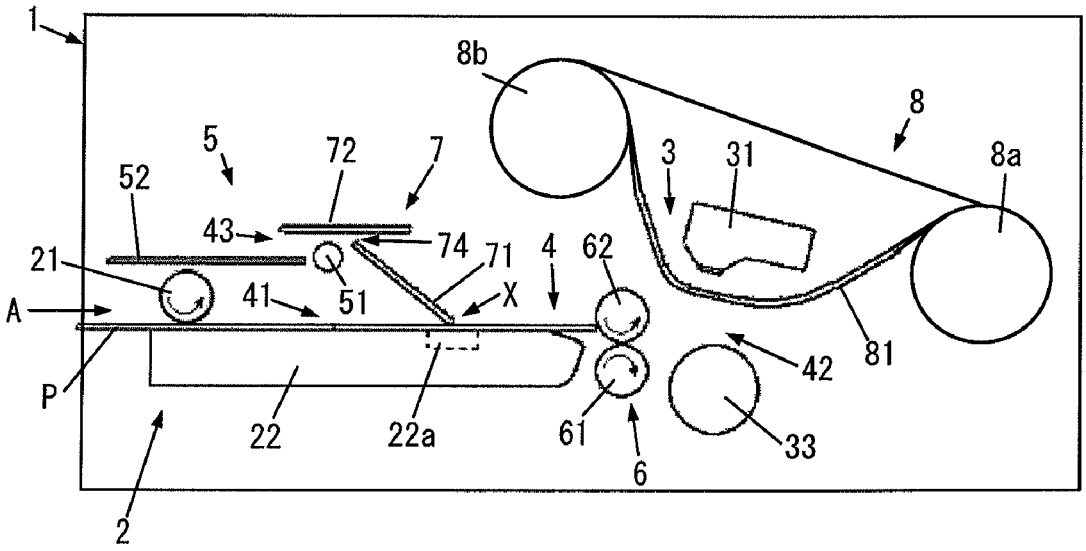
FIG. 1 is a schematic diagram illustrating main components of an image formation device pertaining to an embodiment of the present invention.

A preferred embodiment of the present invention will now be explained with reference to the drawings. It will be apparent to those skilled in the art from this disclosure that the following description of the preferred embodiment of the present invention is provided for illustration only and not for the purpose of limiting the invention as defined by the appended claims and their equivalents.

Referring to FIGS. 1 to 4, an image formation device 1 is illustrated. The image formation device 1 includes a paper feed unit 2, an image formation unit 3, a paper discharge unit 5, a paper conveyance unit 6, a guide plate (or guide unit) 7, an ink ribbon cartridge 8, a chassis (not shown), a drive unit (not shown) and a control unit (not shown). The paper feed unit 2 holds recording paper P, such as printer paper, and feeds the recording paper P to the image formation unit 3. The ink ribbon cartridge 8 holds an ink ribbon 81 with a sublimation dye. The image formation unit 3 sublimates the sublimation dye that coats the ink ribbon 81 and forms an image on the recording paper P. The paper conveyance unit 6 successively conveys the recording paper P to the image formation unit 3. The paper discharge unit 5 discharges the recording paper P. The guide plate 7 guides the recording paper P. The chassis of the image formation device 1 mounts the image formation unit 3, etc. The drive unit of the image formation device 1 includes a drive motor, such as a stepping motor, and a gear group having a drive gear, an intermediate gear, a cam gear and the like. The control unit of the image formation device 1 performs various control functions.

Furthermore, in the image formation device 1, a conveyance path 4 for conveying the recording paper P is formed. The conveyance path 4 includes a paper feed path 41, an image formation path 42 and a paper discharge path 43. Along the paper feed path 41, the paper feed unit 2 feeds the recording paper P to the image formation unit 3. The image formation path 42 is disposed downstream from the paper feed path 41. On the image formation path 42, the image formation unit 3 is provided. The image formation unit 3 prints an image on the recording paper P conveyed along the image formation path 42. Along the paper discharge path 43, the paper discharge unit 5 discharges the recording paper P on which an image has been formed by the image formation unit 3.

The recording paper P includes a printer paper base and a receiving layer formed on the printer paper base. The receiving layer is composed of a thermal transfer recording material. The thermal transfer recording material is generally produced by adding lubricants or the like to a polyester resin, polycarbonate resin or the like.

Figure 6:
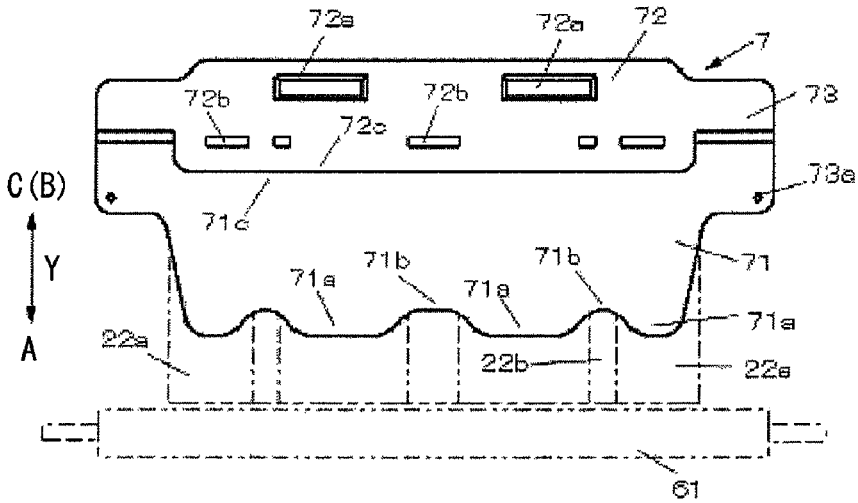
FIG. 6 is a plan view of the guide plate shown in FIG. 5.

The paper feed unit 2 includes the paper feed roller 21 and a bed 22. The paper feed roller 21 is driven by the drive unit of the image formation device 1. The paper feed roller 21 rotates and sends out the recording paper P in a paper feed direction A (a direction from left to right in FIGS. 1 and 2). The bed 22 is located beneath the paper feed roller 21. As shown in FIG. 6, grooves 22*a* and slanted faces 22*b* are formed on the bed 22 along the paper feed path 41. The slanted faces 22*b* are formed between grooves 22*a*.

The ink ribbon cartridge 8 includes a supply member 8*a* and a winding member 8*b*. The supply member 8*a* has a supply bobbin (not shown) that is wound with the ink ribbon 81 and rotatably provided. The winding member 8*b* has a winding bobbin (not shown) for winding the ink ribbon 81. The winding member 8*b* is rotatably provided. The ink ribbon 81 includes a substrate made of paper or film, for example, that serves as a base. The substrate is coated with an ink produced by dissolving a sublimation dye in an acetate, polyester solution or the like, and adding a dispersant to create a colloidal solution. As is commonly known, a yellow printing region, magenta printing region, cyan printing region and surface protection layer region (OP layer) are provided to the ink ribbon 81. The yellow printing region, the magenta printing region, the cyan printing region and the surface protection layer region are substantially the same size as the maximum size (width and length) of the individual images being transferred. Identifiers are also provided between the regions.

The image formation unit 3 includes a thermal head 31, a platen roller 33 and a pressing mechanism (not shown). The image formation unit 3 is configured to print an image on the recording paper P. The thermal head 31 serves as a printing means. The platen roller 33 is disposed across from the thermal head 31 with the ink ribbon 81 in between. The pressing mechanism presses the thermal head 31 against the platen roller 33 during printing.

The thermal head 31 transfers ink of the ink ribbon 81 to the recording paper P during printing an image. Specifically, the thermal head 31 includes a printing head, a heat radiating plate and a head cover. The heat radiating plate radiates heat away from the printing head and the head cover. The printing head has heat generating elements that are arranged in a line over substantially the same length in the width direction (main scanning direction) as that of the image being printed. The heat generating elements convert electrical energy into thermal energy based on print data. Each of the heat generating elements is supplied with a color signal representing an image that is broken down into three primary colors of yellow (Y), magenta (M) and cyan (C). According to the color signal, the heat generating elements change between a state of generating heat and a state of not generating heat. The sublimation dye on the ink ribbon 81 across from the heat generating elements that are generating heat is sublimated or dissolved and diffused, and transferred to the recording paper P. As a result, an image is formed by recording one line at a time while the recording paper P is moved relative to the thermal head 31 in a printing direction B shown in FIG. 3 (a direction from the right to the left in FIG. 3).

The paper conveyance unit 6 is disposed on the image formation path 42. The paper conveyance unit 6 clamps the recording paper P conveyed from the paper feed path 41 and sends the recording paper P to the image formation unit 3. In other words, the paper conveyance unit 6 conveys the recording paper P in the paper feed direction A and/or in a printing direction B (a direction opposite to the paper feed direction A). The paper conveyance unit 6 is driven by the drive unit of the image formation device 1. The paper conveyance unit 6 includes a feed roller 61 and a press roller 62. The feed roller 61 is made of a metal shaft. Part of a surface of the feed roller 61 has an anti-slip texture for reliably conveying the recording paper P. The anti-slip texture is constituted by reticulated knurling that is formed on the surface of the feed roller 61. The press roller 62 is disposed across from the feed roller 61 and follows a rotation of the feed roller 61. The paper conveyance unit 6 may further include a conveyor roller or the like on the conveyance path 4 as needed.

The paper discharge unit 5 includes a paper discharge roller 51, a paper discharge guide 52 and a paper discharge portion (not shown). The paper discharge roller 51 is disposed on the paper discharge path 43. The paper discharge roller 51 is driven by the drive unit of the image formation device 1. The paper discharge roller 51 rotates and discharges the recording paper P on the paper discharge path 43 to the paper discharge portion along the paper discharge guide 52. The paper discharge guide 52 is disposed on the paper discharge path 43. The paper discharge portion is provided upstream of the paper feed direction A (in the printing direction B of the paper discharge guide 52).

Figure 5:
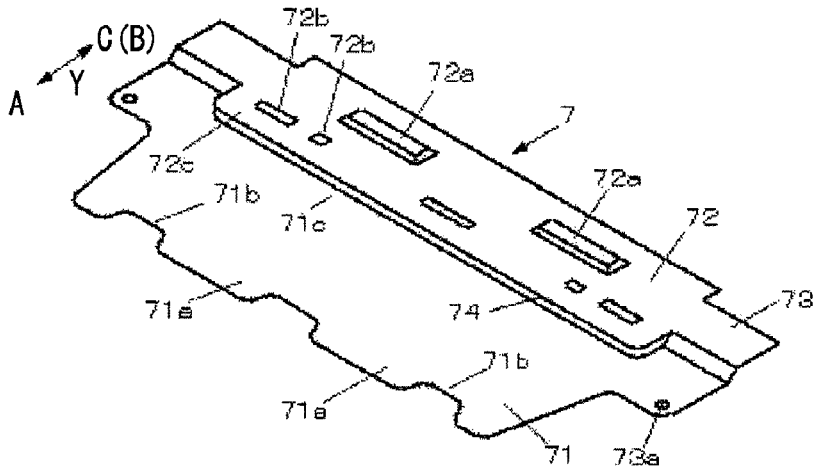
FIG. 5 is an oblique view illustrating a guide plate provided near a branching point in a conveyance path of the image formation device shown in FIG. 1.
Figure 7:
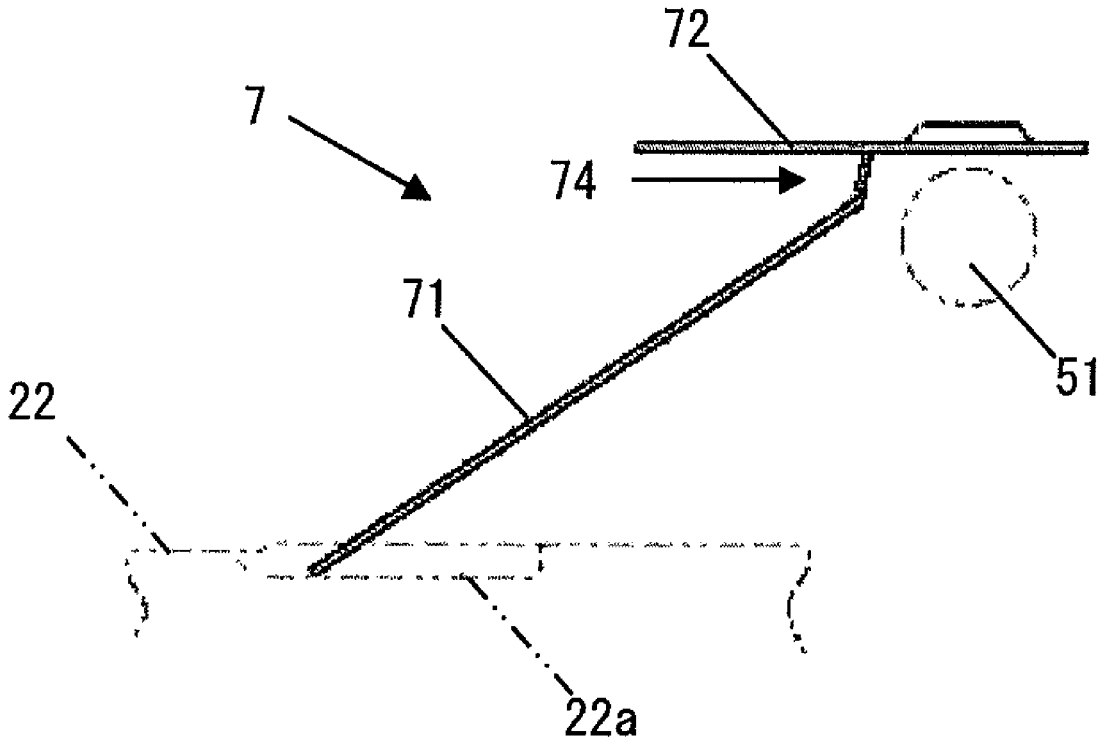
FIG. 7 is a side view of the guide plate shown in FIG. 5.

As shown in FIGS. 5 to 7, the guide plate 7 includes a first guide portion 71, a second guide portion 72 and linking portions 73. The guide plate 7 is integrally formed as a part. Specifically, the first guide portion 71, the second guide portion 72 and the linking portions 73 are formed integrally. The first guide portion 71 is disposed adjacent to a branching point X where the paper feed path 41 and the paper discharge path 43 diverge in the conveyance path 4. Specifically, the first guide portion 71 is disposed above the paper feed path 41 and below the paper discharge path 43. The first guide portion 71 guides the recording paper P along the paper feed path 41 and the paper discharge path 43. More specifically, the first guide portion 71 is positioned on a top side of the recording paper P when the recording paper P is to pass through the paper feed path 41. Furthermore, the first guide portion 71 is positioned on a bottom side of the recording paper P. The first guide portion 71 guides the recording paper P to the paper discharge path 43 when the recording paper P is to pass through the paper discharge path 43 (when the recording paper P is sent from the image formation path 42 to the paper discharge path 43). The second guide portion 72 is disposed above the paper discharge path 43. The second guide portion 72 guides the recording paper P along the paper discharge path 43. More specifically, the second guide portion 72 is positioned on the top side of the recording paper P when the recording paper P is to pass through the paper discharge path 43. The second guide portion 72 guides a conveyance of the recording paper P according to a rotation of the paper discharge roller 51. In other words, the second guide portion 72 guides the recording paper P in a paper discharge direction C (a direction same as the printing direction B) and/or in the paper feed direction A (or a direction from the paper discharge path 43 to the image formation path 42). The linking portions 73 link the first guide portion 71 and the second guide portion 72 integrally. The linking portions 73 are provided to the first guide portion 71 and the second guide portion 72 at both ends in a direction perpendicular to a conveyance direction Y of the recording paper P (or in a lateral direction of the guide plate 7). The conveyance direction Y includes the paper feed direction A and the printing direction B. An opening 74 is formed between the first guide portion 71 and the second guide portion 72 and between the linking portions 73. Through the opening 74, the recording paper P is conveyed. More specifically, the opening 74 is formed between a terminus 71*c* of the first guide portion 71 in the discharge direction C and a start 72*c* of the second guide portion 72 in the discharge direction C.

The first guide portion 71 includes long pieces 71*a* and short pieces 71*b*. The long pieces 71*a* and the short pieces 71*b* are formed alternately at a distal end of the first guide portion 71. The long pieces 71*a* are formed in a tongue-like shape. Distal ends of the long pieces 71*a* are disposed in the grooves 22*a* formed in the bed 22. The distal ends of the long pieces 71*a* are movable as free ends. Distal ends of the short pieces 71*b* are provided so as to conform to the slanted faces 22*b* formed on the bed 22. The first guide portion 71 prevents the recording paper P from returning from the image formation path 42 to the paper feed path 41, and guides the recording paper P to the paper discharge path 43.

The second guide portion 72 includes protrusions 72*a*. The protrusions 72*a* are formed at portions of the second guide portion 72 corresponding to the paper discharge roller 51 in order to prevent the paper discharge roller 51 from contacting the second guide portion 72. Also, latching holes 72*b* are formed on the second guide portion 72. The latching holes 72*b* are used for mounting the guide plate 7 to an attachment member attached directly or indirectly to the chassis of the image formation device 1 by fitting or other such mating. The mounting may be accomplished by adhesive bonding or by screw fastening rather than mating. Furthermore, positioning holes 73*a* are provided to the linking components 73 so that positioning of the guide plate 7 is accomplished more simply in mounting the guide plate 7 to the attachment member. Preferably, the positioning holes 73*a* are fitted to protrusions provided to the attachment member.

The guide plate 7 is made of polyethylene terephthalate (PET), low density polyethylene (LDPE), high density polyethylene (HDPE), polystyrene (PS), acrylonitrile butadiene styrene (ABS), polycarbonate (PC), polyacetal (POM), or polyvinyl chloride (PVC), or a synthetic resin comprising a mixture of two or more of the above materials, such as ABS and PC. The guide plate 7 is integrally formed with a synthetic resin plate by cutting and heat forming. Specifically, the guide plate 7 is produced by cutting (punching, etc.) a specific profile shape (such as that shown in FIG. 6) into or out of a single piece of synthetic resin plate, and then heating and forming in a metal mold to integrally form the guide plate 7 in a desired shape such as that shown in FIG. 5.

Figure 2:
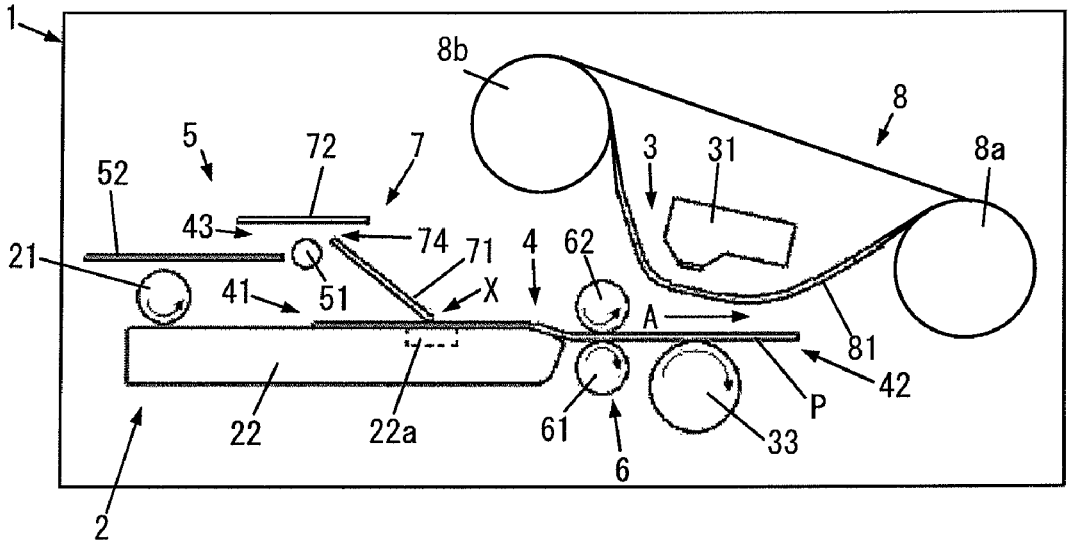
FIG. 2 is a schematic diagram illustrating main components of an image formation device pertaining to an embodiment of the present invention.
Figure 3:
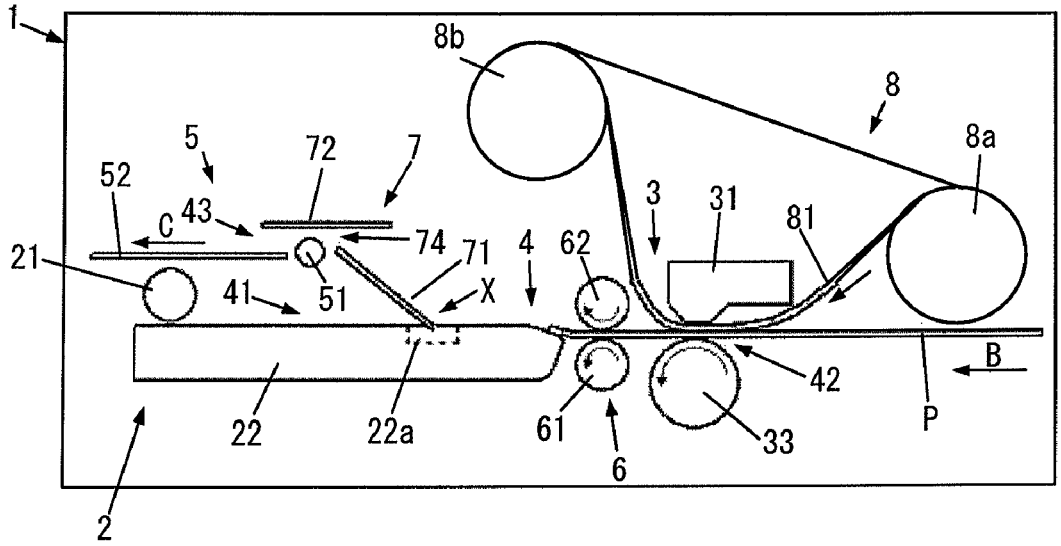
FIG. 3 is a schematic diagram illustrating main components of an image formation device pertaining to an embodiment of the present invention.
Figure 4:
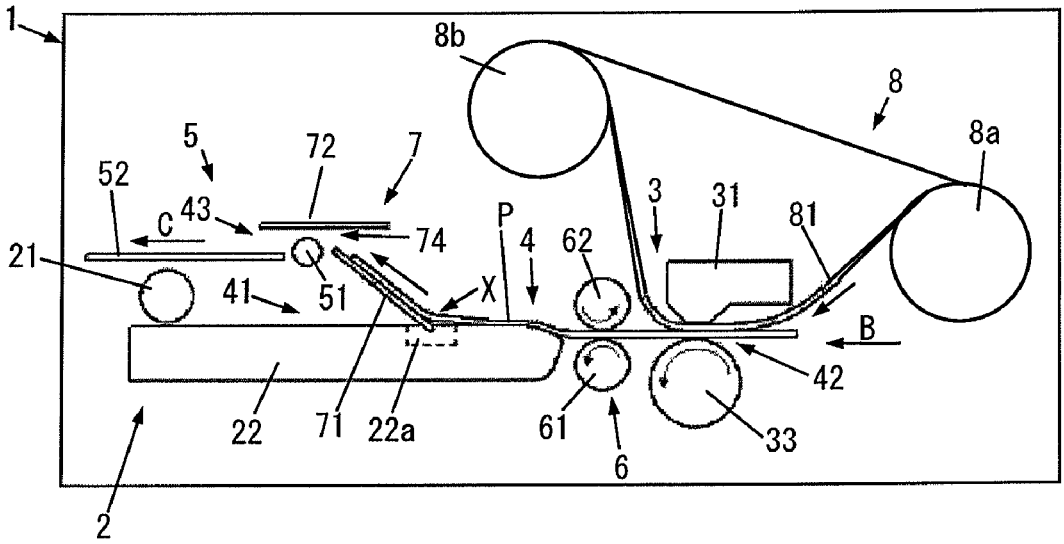
FIG. 4 is a schematic diagram illustrating main components of an image formation device pertaining to an embodiment of the present invention.

With the image formation device 1, the recording paper P is repeatedly moved back and forth in a lengthwise direction of the recording paper P (that is, in the paper feed direction A and the printing direction B (reverse direction)) by the feed roller 61 and the press roller 62 according to the regions of each of the colors successively transferred. As a result, superposed color printing is carried out by the ink ribbon 81 coated with three colors of sublimation dye. Also, the control unit (not shown) drives the drive unit and controls the system so that during printing, the thermal head 31 is pressed to the platen roller 33 by the pressing mechanism as shown in FIGS. 3 and 4. The control unit also controls the system so that during paper feed and discharge, the pressing force of the pressing mechanism is released. Then, the thermal head 31 is retracted as shown in FIGS. 1 and 2.

The printing with the image formation unit 3 is performed as follows. First, as shown in FIGS. 1 and 2, the paper feed roller 21 is rotated to apply drive force in the paper feed direction A to the recording paper P on the bed 22. The paper feed roller 21 and the recording paper P are only in light contact on the paper feed path 41. Therefore, no large frictional force acts between the paper feed roller 21 and the recording paper P. As a result, the recording paper P is conveyed past a lower side of the first guide portion 71 to the image formation path 42. If some kind of braking force should be exerted on the recording paper P, slip can be generated between the paper feed roller 21 and the recording paper P.

The recording paper P is first sent to a farthest point downstream in the paper feed direction A by the paper feed unit 2 within the image formation path 42. Then, the recording paper P is returned in the printing direction B, as shown in FIGS. 3 and 4, to perform printing in the image formation unit 3. At the same time, the ink ribbon 81 is also sent at the same speed and in the same direction as the recording paper P, and is heated by the thermal head 31. As a result, the ink on the ink ribbon 81 is transferred to the surface of the recording paper P. The ink ribbon 81 has four regions of the ink and overcoat. One of the regions is transferred to the recording paper P by a single movement in the printing direction B. The movement is repeated four times (four reciprocations) to complete a color image on the recording paper P.

Once the formation of the color image on the recording paper P is complete, the control unit drives the stepping motor of the drive unit in reverse so that the pressing force of the pressing mechanism on the thermal head 31 is released and the thermal head 31 is raised. Furthermore, the control unit controls the paper discharge roller 51 in the paper discharge path 43 so as to discharge the recording paper P from the main part of the image formation device 1 to the paper discharge portion of the paper discharge unit 5.

With the image formation device 1, there is no need to provide three parts, such as a switching guide, a paper feed guide and a paper discharge guide near the branching point X as a conventional image forming device. Therefore, fewer parts are required. Furthermore, the number of assembly steps is reduced. As a result, there is a reduction in the cost of the image formation device 1.

Also, the guide plate 7 is easily and conveniently produced by a step of cutting into or out of a single piece of synthetic resin, and a heating and forming step.

Furthermore, since the guide plate 7 is formed from a polyethylene terephthalate resin, a coefficient of friction is low. Therefore, the guide plate 7 induces and guides the recording paper P smoothly.

The image formation device 1 may be a thermal head type image formation device in which no ink ribbon is used. Instead of the ink ribbon, a thermal recording paper equipped with a thermosensitive coloration layer may be used as a recording paper. The thermal recording paper is heated with a thermal head to color and record an image.

Furthermore, the guide plate 7 may be applied to an inkjet printer or other image formation devices.

GENERAL INTERPRETATION OF TERMS

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image formation device equipped with the present invention. Accordingly, these terms, as utilized to describe the present invention should be interpreted relative to an image formation device equipped with the present invention as used in the normal operating position. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a preferred embodiment has been chosen to illustrate the present invention, it will be apparent to those skilled in the art from this disclosure that various changes and modifications can be made herein without departing from the scope of the invention as defined in the appended claims. Furthermore, the foregoing description of the preferred embodiment according to the present invention is provided for illustration only, and not for the purpose of limiting the invention as defined by the appended claims and their equivalents.

What is claimed is:

1. An image formation device comprising:

an image formation unit configured to print an image on a recording paper conveyed along an image formation path;

a paper feed unit configured to feed the recording paper to the image formation unit along a paper feed path, the paper feed unit including a bed on which the recording paper is conveyed and a plurality of grooves that is formed on the bed along the paper feed path, respectively;

a paper discharge unit configured to discharge the recording paper along a paper discharge path; and a guide unit disposed adjacent to a branching point where the paper feed path and the paper discharge path diverge, the guide unit including a first guide portion disposed above the paper feed path and below the paper discharge path, the first guide portion being configured to guide the recording paper along the paper feed path and the paper discharge path, a second guide portion disposed above the paper discharge path, the second guide portion being configured to guide the recording paper along the paper discharge path, and linking portions integrally provided to the first guide portion and the second guide portion at both ends in a lateral direction of the guide unit, the guide unit being integrally formed as none-piece, unitary member, the first guide portion including a plurality of tab pieces at distal end portion of the first guide portion, the tab pieces being spaced apart from each other in the lateral direction of the guide unit, distal ends of the tab pieces being located within the grooves of the paper feed unit when the recording paper is conveyed along the paper discharge path.

2. The image formation device according to claim 1, wherein the guide unit is flexibly formed so that the recording paper is prevented from returning from the image formation path to the paper feed path.

3. The image formation device according to claim 2, wherein an opening is formed between the first guide portion and the second guide portion and between the linking portions.

4. The image formation device according to claim 3, wherein the paper feed unit includes a paper feed roller that feeds the recording paper on the paper feed path to the image formation unit by rotation.

5. The image formation device according to claim 4, wherein the paper discharge unit includes a paper discharge roller that discharges the recording paper on the paper discharge path.

6. The image formation device according to claim 5, wherein the image formation unit includes a thermal head. and. a platen roller, and the thermal head is configured to transfer an ink of an ink ribbon to the recording paper during printing the image.

7. The image formation device according to claim 6, wherein the guide unit is integrally formed with a synthetic resin by cutting and heat forming.

8. The image formation device according to claim 7, wherein the synthetic resin is a polyethylene terephthalate resin.

9. The image formation device according to claim 1, wherein the guide unit is integrally formed with a synthetic resin by cutting and heat forming.

10. The image formation device according to claim 9, wherein the synthetic resin is a polyethylene terephthalate resin.

11. The image formation device according to claim 5, wherein the second guide portion further includes a protrusion for preventing the paper discharge roller from contacting the second guide portion.

* * * * *